United States Patent [19]

Ledyashov et al.

[11] Patent Number: 4,809,779

[45] Date of Patent: Mar. 7, 1989

[54] ARRANGEMENT FOR CLEANING INTERNAL SURFACE OF CASING STRINGS

[75] Inventors: Oleg A. Ledyashov, Krasnodarsky krai; Stanislav F. Petrov, Krasnodar; Stanislav P. Goryainov, Krasnodar; Mark L. Kiselman, Krasnodar; Anatoly M. Laptev, Krasnodar; Viktor I. Mishin, Krasnodar, all of U.S.S.R.

[73] Assignee: Vsesojuzny Nauchno-Issledovatelsky Institut Pokrepleniju Skvazhin I Burovym Rastvoram, Krasnodar, U.S.S.R.

[21] Appl. No.: 128,413

[22] Filed: Dec. 3, 1987

[51] Int. Cl.[4] ..... E21B 37/02

[52] U.S. Cl. ..... 166/173; 15/104.16; 166/174

[58] Field of Search ..... 166/173, 174, 170, 212; 175/267, 269, 325; 15/104.16, 104.19

[56] References Cited

U.S. PATENT DOCUMENTS

| | | | |
|---|---|---|---|
| 2,603,163 | 7/1952 | Nixon | 166/212 |
| 2,627,925 | 2/1953 | Scivally | 166/173 |
| 2,713,913 | 7/1955 | Ragan | 166/173 |
| 2,785,758 | 3/1957 | Baker | 166/212 |
| 2,804,152 | 8/1957 | Scivally | 166/173 |
| 2,857,141 | 10/1958 | Carpenter | 166/174 X |
| 2,915,126 | 12/1959 | Potts | 166/212 X |
| 3,199,599 | 8/1965 | Kammerer, Jr. | 166/173 |

FOREIGN PATENT DOCUMENTS 649829 2/1979 U.S.S.R. .

OTHER PUBLICATIONS

Casing Scraper, Model "C-3", Roto-Vert Casing Scraper, Product No. 620-03, Composite Catalog, vol. 1, 1984–1985, Gulf Publishing Co., Houston, Tex., pp. 808–809.

*Primary Examiner*—Stephen J. Novosad

*Attorney, Agent, or Firm*—Fleit, Jacobson, Cohn & Price

[57] ABSTRACT

An arrangement for cleaning the internal surface of casing strings, comprises a hollow cylindrical body with slots provided around the periphery thereof. The slots accommodate extendable cutting blades. The cutting blades are moved with the aid of walls of an elastic vessel. The elastic vessel is disposed inside the body and adapted to be communicated with a source of compressed fluid medium. The elastic vessel is disposed in a bushing installed coaxially with the body and provided with longitudinal ports. The ports are arranged opposite to the slots of the body and are equipped with flat spring elements. The flat spring elements substantially completely cover the ports of the bushing and cooperate by one side with the cutting blades and by the other side, with the elastic vessel.

6 Claims, 2 Drawing Sheets

ARRANGEMENT FOR CLEANING INTERNAL SURFACE OF CASING STRINGS

TECHNICAL FIELD

The present invention relates to remedial work on oil, injection, gas and other wells and is more specifically concerned with an arrangement for cleaning the internal surface of casing strings.

BACKGROUND OF THE INVENTION

The present invention is intended for a complete and qualitative cleaning of casing string sections from any deposits and built-up metal, as well as for restoring a complete passability of separate well bore sections along the inside diameter. The arrangement is operated in drilling mud, water, oil and mineralized stratum fluid.

In addition the present invention may advantageously be used for cleaning tubular heat exchangers of scale (in the process of overhaul) and other tubular internal surfaces with a constant or slightly varying inside diameter.

The practical remedy of casing strings by means of steel patches proves that a positive result of this operation is possible only if the internal surface of the pipes is thoroughly cleaned along the string section wherein the patch it to be installed.

The presence of corrosion products, cement cake, deposits of salts, as well as burrs and built-up metal on the walls of a casing string in the zone of perforation excludes the snug bearing of the patch against the casing pipe and consequently the achievement of the tightness thereof. When the patch is expanded in a contaminated casing pipe, it may be displaced along the casing string.

The use of pressuring packers and packers to be installed on the tubing string in injection wells, as well as the use of other downhole equipment requiring the snug bearing against the pipe wall (formation testers, and so forth) or power cooperation therewith (anchors) are likewise hampered.

Known in the prior art is a mechanical scraper for cleaning casing strings (Composite Catalog, v. 1, 1984–1985, pp. 808–809, model "C-3", roto-vert, casing scraper, product 620-03), comprising a massive hollow body externally accommodating cutting blades constantly forced by springs against the wall of a casing string under cleaning. The scraper design contemplates the use of a plurality of sets of changeable cutting blades each of which is intended for operation in a narrow range of well bore inside diameters (depending on standard sizes of casing pipes and thickness of their walls).

The mechanical scraper is run in a well to a section to be cleaned on a drill pipe string or tubing string and is commonly operated in conjunction with recirculation of the washing fluid for carrying the products of cleaning away from the wall to the surface.

The process of cleaning may be accomplished both by rotating the scraper and feeding it simultaneously downwards, and by reciprocating it along the string.

The first method is more efficient, however, it is used preferably for cleaning casing pipes of soft and homogeneous deposits of salts, gypsum, mud cake, etc. However when a casing string is to be cleaned of a cement cake, it is recommended to rotate the scraper and simultaneously to drill out the cement bridging plug.

When cleaning the casing string of hard heterogeneous deposits, and moreover when dealing with burrs and built-up metals in the zone of perforation, rotation of the scraper leads to jerks and twisting of the string resulting in jamming and break of the pipes.

For cleaning in such conditions, it is recommended to use the reciprocating motion of the scraper.

A disadvantage of the heretofore described method resides mainly in a low efficiency of cleaning resulting from an inconsiderable force exerted by cylindrical or flat springs for pressing the cutting blades against the surface being cleaned. The force applied to one cutting blade in an appropriate range of the well bore inside diameters comprises 0.7–1.5 kN which corresponds to an average specific load of 0.1–0.2 MPa on the working surface and may ensure only a low-efficient surface attrition. A small working range of compression of the springs limits the radial travel of a cutting blade (up to 5 mm) which involves the use of a plurality of sets of cutting blades in each standard size of the scrapers.

The fact that the cutting blades of a mechnical scraper are constantly forced against the surface being cleaned involves difficulties in entering the scraper in a casing string, reduces the speed of the scraper running the well because of a possible sticking in contaminated sections of the string and in well bore sections with an excessive curvature. This causes an additional wear of cutting edges. In the casing string sections with cracks, burnouts and especially in the zone of perforation, the speed of the scraper running is limited down to 10 m/min, as despite inconsiderable force the cutting blades may thrust against hard projections or sink in the spaces therebetween, thereby causing sticking of the tool with hazardous consequences.

Cleaning the casing string of hard deposits requires prolonged multihour operation of the scrapers, however metal projections on the string surface remain quite unaffected by cleaning.

Also known in the prior art is a hydromechanical arrangement for cleaning uncased well bores of loose mud cake (SU, A No. 649,829).

The arrangement is provided with an elastic extending vessel accommodated in the body. While expanding under the action of a pressure differential, the vessel acts directly on pivoted segments (cutting blades), thereby extending them from the slots of the body until they come in contact with the surface to be cleaned. The pivoted segments in are installed in the body on pivot pins. In order to fasten the ends of the vessel, a bushing with ducts for passage of fluid is provided thereinside. The hydromechanical arrangement is designed for mud grouting of the walls of uncased well bore in the process of drilling. The arrangement has run-in and working positions. The arrangement is changed over from the run-in to the working position under the action of a pressure differential built up in the working space due to the slush nozzles of a bit after lowering in the well to the section to be cleaned.

The arrangement is operated only by means of rotary motion at a slight pressure differential which along with the action of the centrifugal force on the pivoted segments provides on the contacting surface a force sufficient for a partial cleaning and a loose mud cake grouting. The arrangement is designed for operation on the shaft of a turbodrill.

Disadvantages of this arrangement preventing its effective use for cleaning the casing strings reside in the following.

Effective cleaning of a casing string from built-up metal and dense deposits requires that the cutting blade is pressed against the casing pipe wall with a force of several tons to which corresponds operation of the scraper at a pressure differential of 4–6 MPa. When the cutting blade is extended into the working position the vessel walls are subjected to extension. A sharp bend and an additional local extension of the vessel elastic material are caused under the action of the pressure differential on the shoulders between the body and the extended cutting blade, especially in a longitudinal section of the scraper. Besides, at a great pressure differential the elastic material of the vessel is forced (flows) in the clearance between the body and the movable cutting blade and is further pinched (seized). Multiple extension on the shoulders and pinching of the elastic material leads to a rapid destruction of the vessel.

When casing strings are under overhaul the scraper is usually run in on the tubing allowing the cleaning to be carried out only by the reciprocating motion without rotating the scraper when fails to ensure the effective cleaning of the internal surface of the casing strings from hard deposits and built-up metal. The scraper with the pivoted cutting blades (segments) is not fit for operation in such conditions, as the cutting blades have a slight almost linear contact with the circumference of the surface being cleaned.

The arrangement is not provided with a mechanism for returning the pivoted segments to the run-in position after release of the pressure.

ESSENCE OF THE INVENTION

It is an object of the invention to provide an arrangement for cleaning the internal surface of casing strings allowing the internal surface of the casing strings to be effectively cleaned of hard deposits and built-up metal.

The invention resides in that in an arrangement for cleaning the internal surface of casing strings, comprising a hollow cylindrical body with slots provided around the circumference thereof and accommodating extendable cutting blades moved with the aid of walls of an elastic vessel which is adapted to be communicated with a compressed fluid medium source and is internally accommodated in a bushing disposed coaxially with the body and provided with longitudinal ports arrangement opposite to the slots of the body and equipped with flat spring elements which substantially completely cover the ports in the bushing and cooperate by one side with the cutting blades and by the other side, with the elastic vessel.

Such an embodiment of the arrangement for cleaning the internal surface of casing strings provides the conditions for a reliable operation of the vessel at an excess pressure of 5–6 MPa and upward, and ensures the transmission of a force of 30–50 kN to each cutting blade. Action of the cutting blades under such forces on the surface to be cleaned radially improves the efficiency of cleaning.

It is desirable that the outside diameter of the bushing be substantially equal to the inside diameter of the body.

Such a solution makes it possible to provide a built-up body in which the registered spaces (slots of the body and ports of bushings) suitably accommodate the means through the medium of which the elastic vessel cooperates with the cutting blades.

As a result, it becomes possible to use higher pressures without any harm to the strength of the elastic vessel and consequently to improve the efficiency of cleaning.

The flat spring elements may advantageously be made in the form of arc-shaped springs projecting by the convex portions thereof inside the bushings through the ports and having the flat ends disposed in recesses provided on the external surface of the bushing.

When the cutting blade is extended until it comes in contact with the surface to be cleaned, the arc-shaped portion of the spring straightens out, thereby covering the ports of the bushing without any clearances and shoulders in the longitudinal section and forming only minimal shoulders in the cross-section. In addition, the arc-shaped embodiment of the flat spring provides the change-over of the arrangement from the working to the run-in position by retraction of the cutting blades in the body slots accomplished after release of the pressure.

It is preferred that the elastic vessel be made of a rubber-fabric. material.

Reinforcement of the vessel material with a fabric adds strength to the vessel walls by many fold, thereby preventing the flow-in and subsequent pinching of the elastic material under the action of a great pressure differential. As a result, the vessel durability and the value of an excess working pressure are sharply increased.

It is advantageous to dispose the cutting blades at least in two rows so that their cutting edges cover the entire perimeter of the circle circumscribed by the fully extended cutting blades divided into two groups, in one of which the cutting edges of the blades are made sloping to the left and in the other group the cutting edges are made sloping to the right.

When employing the main method of cleaning a casing string by the reciprocating motion of the arrangement, such an embodiment eliminates the need for a periodical turning of the scraper and in addition guarantees the counterbalancing of tangential forces brought about in the arrangement due to sloping disposition of the cutting edges on the blades.

The spring elements may suitably be connected with the cutting blades for limited movement relative to one another.

Such a connection provides the efficient contact between the flat spring and the cutting blades in the process of force transmission and the full retraction of the cutting blades in the scraper body in the run-in position.

SUMMARY OF THE DRAWINGS

The objects and advantages of the invention will become more apparent from the following description in which the preferred embodiment is set forth in detail in conjunction with the accompanying drawings, wherein.

DETAILED DESCRIPTION OF THE INVENTION

Figure 1:
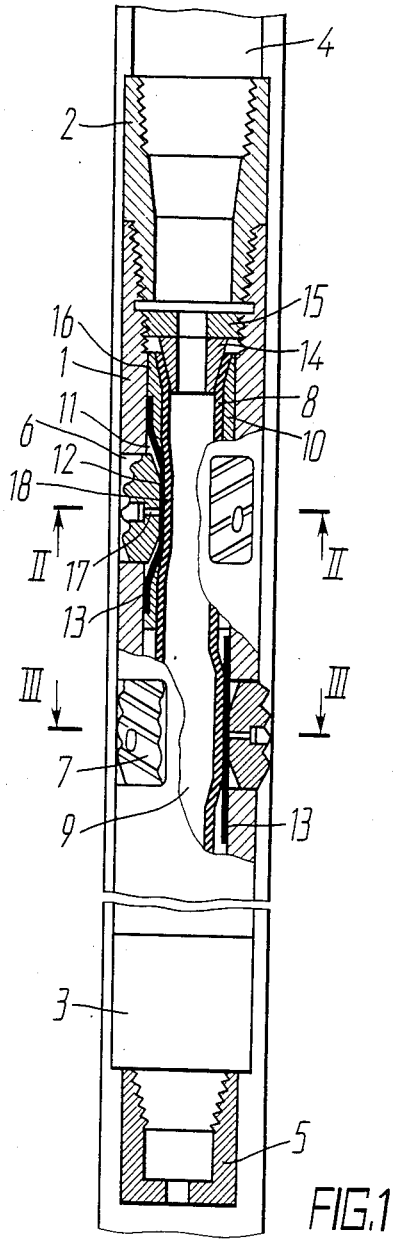
FIG. 1 is a view partly in longitudinal section illustrating the arrangement for cleaning the internal surface of casing strings, according to the invention.

The diagrammatic sketch illustrating the proposed arrangement partly in a longitudinal section is presented in FIG. 1. The arrangement in the run-in position is shown in the sketch to the left of the centre line and in the working position, to the right of the centre line.

Figure 2:
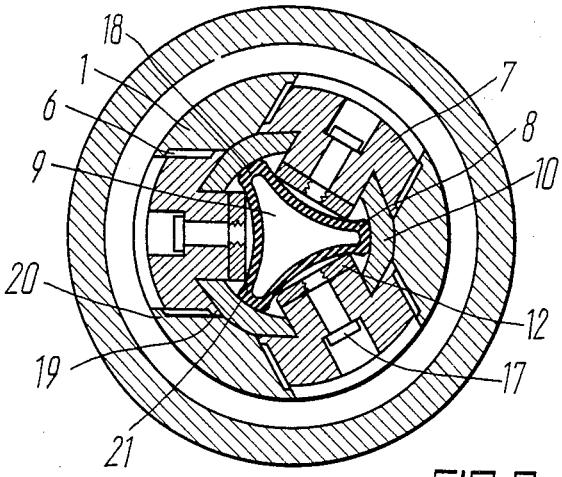
FIG. 2 is a section taken on line II—II of FIG. 1.
Figure 3:
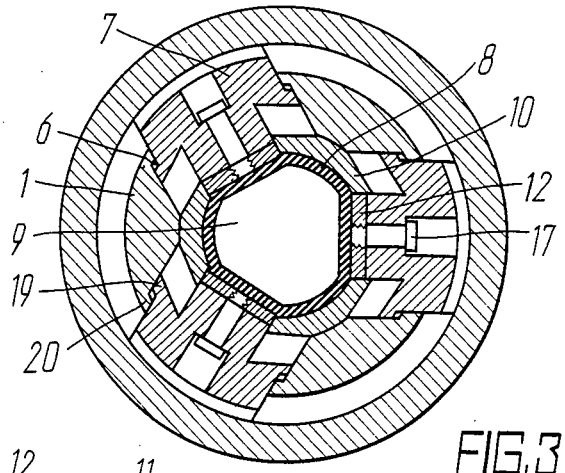
FIG. 3 is a section taken on line III—III of FIG. 1.

An arrangement comprises a hollow cylindrical body 1 (FIG. 1) with subs 2 and 3 for connection to a string 4 and a bit (or connection) 5. Extendable cutting blades 7 are disposed in peripheral slots 6 of the body 1. The cutting blades 7 and other elements of the arrangement construction are also illustrated in FIG. 2 and FIG. 3 in the run-in and working positions respectively. An elastic vessel 8 is disposed inside the arrangement. A space 9 of the vessel 8 is communicated at the top portion with a source of compressed fluid medium, i.e. with a pumping unit (not shown) by means of a tubing string or a drill pipe string through which the drilling fluid (i.e. fluid medium) is injected in the well. At the bottom portion the space 9 of the vessel 8 is communicated with nozzles of the bit (connections) 5 by means of which an excess pressure is built up in this space during circulation of the drilling fluid.

Installed between the body 1 and the elastic vessel 8 are intermediate bushings 10 provided with longitudinal ports 11 which are disposed opposite to the slots 6 of the body 1 and provided with flat spring elements 12 substantially completely covering the ports 11 of the bushing 10.

The flat spring elements 12 made in the form of arc-shaped springs project by their central convex portion inside the bushing 10 through the ports 11. Flat ends of the springs 12 are disposed in special recesses 13 provided on the external surface of the bushing 10 and rest against the body 1.

Ends of the elastic vessel 8 are reliably secured inside the bushings 10 by means of cones 14 and pressure nuts 15, providing a hermetic sealing of the arrangement at a build-up of the excess pressure. Rubber rings 16 are made for the same purpose on the external surface of the bushings 10 which are a running fit in the body 1.

The flat spring elements 12 are connected with the cutting blades 7 by means of screws 17. The connection is made with a definite limited relative mobility which provides an efficient cooperation of the flat spring elements and the cutting blades 7 in transmission of the force and a complete retraction of the cutting blades 7 in the slots 6 of the body 1 when the arrangement is switched over to the run-in position.

The elastic vessel 8 is made of a rubber-fabric pressure hose.

In the run-in position when the cutting blades 7 are retracted in the slots 6 of the body 1, longitudinal folds 18 (FIG. 2) are formed at appropriate places on the surface of the elastic vessel 8 and are straightened out as the cutting blades 7 (FIG. 3) are extended.

To provide a complete engagement of the surface to be cleaned during the reciprocating motion of the arrangement, the extanable cutting blades 7 are disposed in two rows (FIG. 1) having three blades in each row (FIGS. 2 and 3) and displaced through 60°.

In order to counterbalance the tangential forces brought about in the arrangement due to the sloping disposition of the cutting edges, one half of the cutting blades 7 have the cutting edges sloping to the left and one half have the cutting edges sloping to the right.

All the cutting blades 7 have an independent "floating" disposition in the slots 6 of the body 1. If an almost insurmountable obstruction is encountered on the wall of a casing string, (e.g., a large piece of built-up metal) the cutting blade 7 freely retracts in the body 1, thus preventing any danger of the tool jamming.

When assembling the arrangement the cutting blades are inserted in the slots 6 of the body 1 from the inside. Provided on the side surfaces of the cutting blades 7 and respectively in the slots 6 of the body 1 are limiting collars 19 and 20 which prevent the cutting blades 7 from falling out in the well during operation of the arrangement.

The arrangement operates in the following way. In the run-in position, when the arrangement is run in and pulled out of a well, the cutting blades 7 are retracted in the slots 6 of the body 1 by the flat spring elements 12 which rest by their flat ends against the body 1, while their central portions project inside the bushings 10 through the ports 11, thereby making the longitudinal folds 18 on the elastic vessel 8 (FIGS. 1 and 2).

The possibility of changing over the arrangement to the run-in position, i.e. to cut the arrangement out of operation, in which the cutting blades 7 are retracted the slots 6 of the body 1, makes it possible to run in the arrangement to the section to be cleaned and to pull it out without any troubles and speed restrictions. The arrangement is entered in a casing string without any hinderance.

After the arrangement has been run in the section to be cleaned the circulation of the drilling fluid through the string of pipes 4 is restored and an excess pressure of 3–6 MPa is built up in the space 9 of the elastic vessel 8. The value of excess pressure is controlled by changing the diameter of the drilling fluid passages of the connection 5 or more expeditiously by changing the output of a pumping unit.

When the arrangement is cut into operation the elastic vessel 8 extends the cutting blades 7 from the slots 6 of the body 1 by acting upon them through the spring 12 by its outer wall. The cutting blade is pressed against the surface to be cleaned (FIGS. 1 and 3) with force corresponding to the value of an excess pressure.

The flat ends of the flat spring element 12 constantly rest against the arrangement body 1 and practically do not change their position relative to the bushing 10. The arc-shaped portion of the flat spring element 12 disposed in the longitudinal port 11 of the bushing 10 is straightened out under the action of the wall of the elastic vessel 8, enters the port 11 of the bushing 10 and covers the shoulder between the body 1 and the extended cutting blade 7 in the longitudinal section (FIGS. 1 and 3).

As a result, a bend and a local extension of the elastic material of the vessel 8 forced against the internal surface of the arrangement by the excess pressure are completely avoided in this section.

In the cross-section of the arrangement, a shoulder 21 is formed between the bushing 10 and the flat spring element 12 because of a different thickness of the walls of casing pipes and the deposited layer to be cleaned off.

Figure 4:
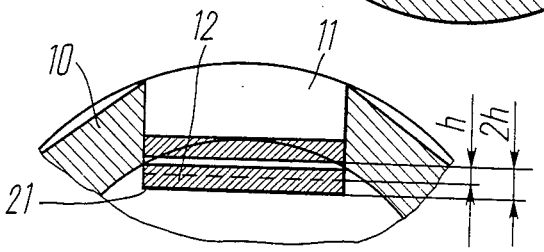
FIG. 4 diagrammatically illustrates on an enlarged scale two extreme positions of the flat spring element during its displacement in longitudinal ports 11.

The height of the shoulder 21 (FIG. 4) varies from h to 2h depending on the difference in thickness of walls of produced pipes. The maximum height of the shoulder 21 for the production casing strings comprises ±2.75 mm.

The longitudinal folds 18 of the elastic vessel 8 are straighened out under the action of the excess pressure and closely fits to the shoulder 21 practically without any local extention of the elastic material.

It should be noted that in the period when the cutting blades 7 are extended from the body 1 till the moment when they come in contact with the surface to be cleaned, the elastic vessel 8 is practically not subject to any load, as it overcomes only the resistance of the spring 12 being straightened out.

During operation of the arrangement the main portion of the elastic vessel 8 is also not subjected to breaking loads, as the excess pressure in the space 9 is completely relieved through the wall of the elastic vessel 8 acting on the internal surface of the bushing 10 and the spring 12. The danger of destruction arises mainly at places where the elastic vessel 8 covers the shoulder 21 with a clearance and conditions arise for flowing of the elastic material in the clearance and for its subsequent pinching (seizing).

The use of the intermediate bushing 10 with the flat spring element 12 makes it possible to eliminate the cause of destruction of the elastic vessel 8 in the longitudinal section and to reduce it to a minimum in the cross-section (due to the minimum value of the height of the shoulders 21).

Reinforcement with a fabric adds strength to the walls of the elastic vessel 8 by many fold which together with the advantages heretofore described radically improves the durability of the elastic vessel 8 in the recommended range of high working pressures.

Design of the arrangement provides a sufficient radial travel of the cutting blades 7 ensuring the effective use of the arrangement in the entire range of wall thicknesses of the production casing pipes of one standard size; at a definite excess pressure the force with which the cutting blades 7 engage the surface to be cleaned is not dependent on the degree of the cutting blade extension from the body 1 and consequently on the thickness of a pipe wall and deposited layer. Therefore, sets of changeable cutting dies are not contemplated by the design of the arrangement. Diameter of the body 1 is selected so as to ensure the reliable passability of the arrangement through the casing string sections having the maximum wall thickness.

The arrangement is intended for trouble-free and prolonged operation at a great excess pressure which may be expeditiously controlled, depending on the conditions of cleaning. Corresponding to the recommended excess pressure of 5–6 MPa is a load of 30–50 kN acting on each cutting blade in place of 0.7–1.5 kN acting on a spring-loaded cutting blade of a mechanical scraper or respectively an average specific load of 1.5–3.0 MPa acting on the cutting blade in place of 0.1–0.13 MPa. This fact primarily ensures a radical increase in the intensity of cleaning and makes it possible to completely clean off the most hard deposits and built-up metal.

Moreover the intensity of cleaning rises further not in proportion to the rise of the load (25–30 times) but is many times greater due to the fact that the mode of a volumetric destruction of mineral deposits and cutting of metal projections takes place instead of the surface attrition process.

Inspections of the recovered strings have shown that the coats of polymeric materials, epoxy resin, as well as pieces of built-up metal 3–6 mm thick left on the internal surface of pipes after electric welding were completely cleaned off to bright metal in 8–10 passes of the scraper. Metal chips similar to those produced on a planning machine were washed away from the well.

The excess pressure may advantageously be reduced down to 2.5–3 MPa for cleaning off deposits of soft and medium-hard materials to avoid pressing of slag in the channels between the cutting edges of the blades and an excessive contamination of the fluid flow.

A pressure of 5–6 MPa is intended for cleaning off hard deposits. Design of the arrangement readily allows an increase in the load up to 10–15 MPa and upward. However, in this case the dynamics of cleaning process, the axial force required for moving the arrangement, etc. are sharply increased.

The cutting structure of the blades is shaped so that not only projections and deposits are cleaned off without damaging the pipe wall but on the contrary production irregularities left on the pipe wall surface are smoothed out.

A casing string may be cleaned both by imparting a reciprocating motion to the arrangement and by rotating and gradually feeding the arrangement downwards.

A reliable control of the cleaning process is feasible.

What we claim is:

1. An arrangement for cleaning the internal surface of casing strings comprising:

a source of compressed fluid medium;

a hollow cylindrical body;

slots provided around the periphery of said hollow cylindrical body;

extendable cutting blades disposed in said slots;

an elastic vessel disposed inside said hollow cylindrical body and communicating with a compressed fluid medium source;

walls of the elastic vessel, adapted to move said extendable cutting blades;

a bushing disposed coaxially with said hollow cylindrical body and accommodating said elastic vessel;

longitudinal ports provided in said bushing and arranged opposite to said slots of said hollow cylindrical body;

flat spring elements substantially completely covering said longitudinal ports of said bushing;

sides of said flat spring elements, cooperating with said extendable cutting blades;

other sides of said flat spring elements cooperating with said elastic vessel.

2. A device as claimed in claim 1, wherein the outside diameter of the bushing is substantially equal to the inside diameter of the body.

3. An arrangement as claimed in claim 1, wherein said flat spring elements are made in the form of arc-shaped springs projecting by the convex portions thereof inside said bushing through said longitudinal ports and having the flat ends disposed in recesses provided on the external surface of said bushing.

4. An arrangement as claimed in claim 1, wherein said elastic vessel is made of a rubber-fabric material.

5. An arrangement as claimed in claim 1, wherein said extendable cutting blades are disposed at least in two rows so that their cutting edges cover the entire circumference of the circle circumscribed by the fully extended cutting blades divided in two groups, in one of which the cutting edges of said extendable cutting blades are made sloping to the left, and in the other group the cutting edges of said extendable cutting blades are made sloping to the right.

6. An arrangement as claimed in claim 1, wherein said flat spring elements are connected with said extendable cutting blades for limited movement relative to one another.

* * * * *